US009959960B2

(12) United States Patent
Chen et al.

(10) Patent No.: US 9,959,960 B2
(45) Date of Patent: May 1, 2018

(54) MAGNETIC COMPONENT

(71) Applicant: DELTA ELECTRONICS, INC., Taoyuan (TW)

(72) Inventors: Yi-Lin Chen, Taoyuan (TW); Yi-Fan Wu, Taoyuan (TW); Zhi-Liang Zhang, Taoyuan (TW); Ching-Hsien Teng, Taoyuan (TW); Yu-Liang Hung, Taoyuan (TW); Han-Hsing Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 52 days.

(21) Appl. No.: 15/182,276

(22) Filed: Jun. 14, 2016

(65) Prior Publication Data

US 2017/0278622 A1 Sep. 28, 2017

(30) Foreign Application Priority Data

Mar. 22, 2016 (CN) ..... 2016 1 0164329

(51) Int. Cl.

| | |
|---|---|
| ***H01F 27/30*** | (2006.01) |
| ***H01F 3/10*** | (2006.01) |
| ***H01F 27/29*** | (2006.01) |
| ***H01F 27/28*** | (2006.01) |

(52) U.S. Cl.

CPC ..... *H01F 3/10* (2013.01); *H01F 27/28* (2013.01); *H01F 27/2866* (2013.01); *H01F 27/29* (2013.01); *H01F 27/30* (2013.01); *H01F 27/306* (2013.01)

(58) Field of Classification Search

CPC ..... H01F 27/00–27/36
USPC ... 336/65, 83, 196, 192, 198, 210, 212, 200, 336/220–223, 232

See application file for complete search history.

(56) References Cited

U.S. PATENT DOCUMENTS

| | | | | |
|---|---|---|---|---|
| 7,498,921 | B1 * | 3/2009 | Wang | H01F 27/2852 336/200 |
| 8,179,222 | B2 * | 5/2012 | Lee | H01F 27/2847 336/208 |
| 9,202,621 | B2 * | 12/2015 | Wild | H01F 5/02 |
| 9,396,865 | B1 * | 7/2016 | Folker | H01F 27/2804 |
| 2012/0038448 | A1 * | 2/2012 | Kim | H01F 27/325 336/192 |
| 2013/0099887 | A1 * | 4/2013 | Yamamoto | H01F 30/06 336/220 |

* cited by examiner

*Primary Examiner* — Tuyen Nguyen

(74) *Attorney, Agent, or Firm* — Kirton McConkie; Evan R. Witt

(57) ABSTRACT

A magnetic component is disclosed. The magnetic component includes a magnetic core assembly, a fastening element, a first winding set and a second winding set. The magnetic core assembly includes at least a pillar. The fastening element is provided on an outer peripheral surface of the pillar. The first winding set is disposed around the outer peripheral surface of the pillar. The second winding set is disposed around the outer peripheral surface of the pillar and engaged with the fastening set. The first winding set and the second winding set are located adjacent to each other and disposed around the outer peripheral surface of the pillar.

16 Claims, 12 Drawing Sheets

MAGNETIC COMPONENT

TECHNICAL FIELD

The present disclosure relates to a magnetic component, and more particularly to a bobbinless magnetic component.

BACKGROUND OF THE DISCLOSURE

Transformers are magnetic assemblies and are widely applied in various electronic devices for regulating various voltages required for various kinds of electric appliances. With development trends of electronic devices such as power supplies toward more compact, high-power-density and high efficiency, it is desirable for transformers to have a compact design and high efficiency, so as to meet practical requirements.

FIG. 1 is a schematic exploded view illustrating a conventional transformer 1, comprising a magnetic core assembly 11, a bobbin 12, a primary winding coil 13, a secondary winding coil 14 and an insulating tape 15. The primary winding coil 13 and the secondary winding coil 14 are wound around the bobbin 12 and separated from each other via the insulating tape 15. The magnetic core assembly 11 comprises a first magnetic core 111 and a second magnetic core 112, each having respective central pillars 111*a*, 112*a* accommodated within a channel 121 of the bobbin 12. The primary winding coil 13, the secondary winding coil 14 and the bobbin 12 are partially enclosed by the first magnetic core 111 and the second magnetic core 112. Voltage regulation is performed by the electromagnetic induction effect among the magnetic core assembly 11, the primary winding coil 13 and the secondary winding coil 14 of the transformer 1.

In the conventional transformer 1, the bobbin 12 is an indispensable element for winding the primary winding coil 13 and the secondary winding coil 14 therearound. The bobbin 12 has a cylindrical sleeve portion with a wall thickness. With a fixed-size transformer, the winding space is limited by the wall thickness of the bobbin 12, and the number of the winding turns cannot be increased. Accordingly, having the bobbin 12 in the transformer design limits the available winding space and the efficiency of the transformer 1. In addition, the bobbin 12 adds to the material cost of the transformer 1, as well as limiting potential designs for volume reduction.

Therefore, it is desirable to provide a bobbinless magnetic component which may obviate the drawbacks of the prior art.

SUMMARY OF THE DISCLOSURE

The present disclosure provides a bobbinless magnetic component. In accordance with an aspect of the present disclosure, the magnetic component includes magnetic core assembly and winding coils. The winding coils are directly wound or disposed around the magnetic core assembly, so as to increase the winding space of the magnetic component, improve the efficiency of the magnetic component, reduce the material cost, decrease the volume of the magnetic component and facilitate assembling.

In accordance with another aspect of the present disclosure, there is provided a magnetic component including a magnetic core assembly, a fastening set, a first winding set and a second winding set. The magnetic core assembly includes a pillar. The fastening set is provided on an outer peripheral surface of the pillar. The first winding set is disposed around the outer peripheral surface of the pillar. The second winding set is disposed around the outer peripheral surface of the pillar and engaged with the pillar via the fastening set.

The present disclosure will be more apparent to those ordinarily skilled in the art after reviewing the following detailed description and accompanying drawings, in which:

DETAILED DESCRIPTION OF THE PREFERRED EMBODIMENT

Figure 1:
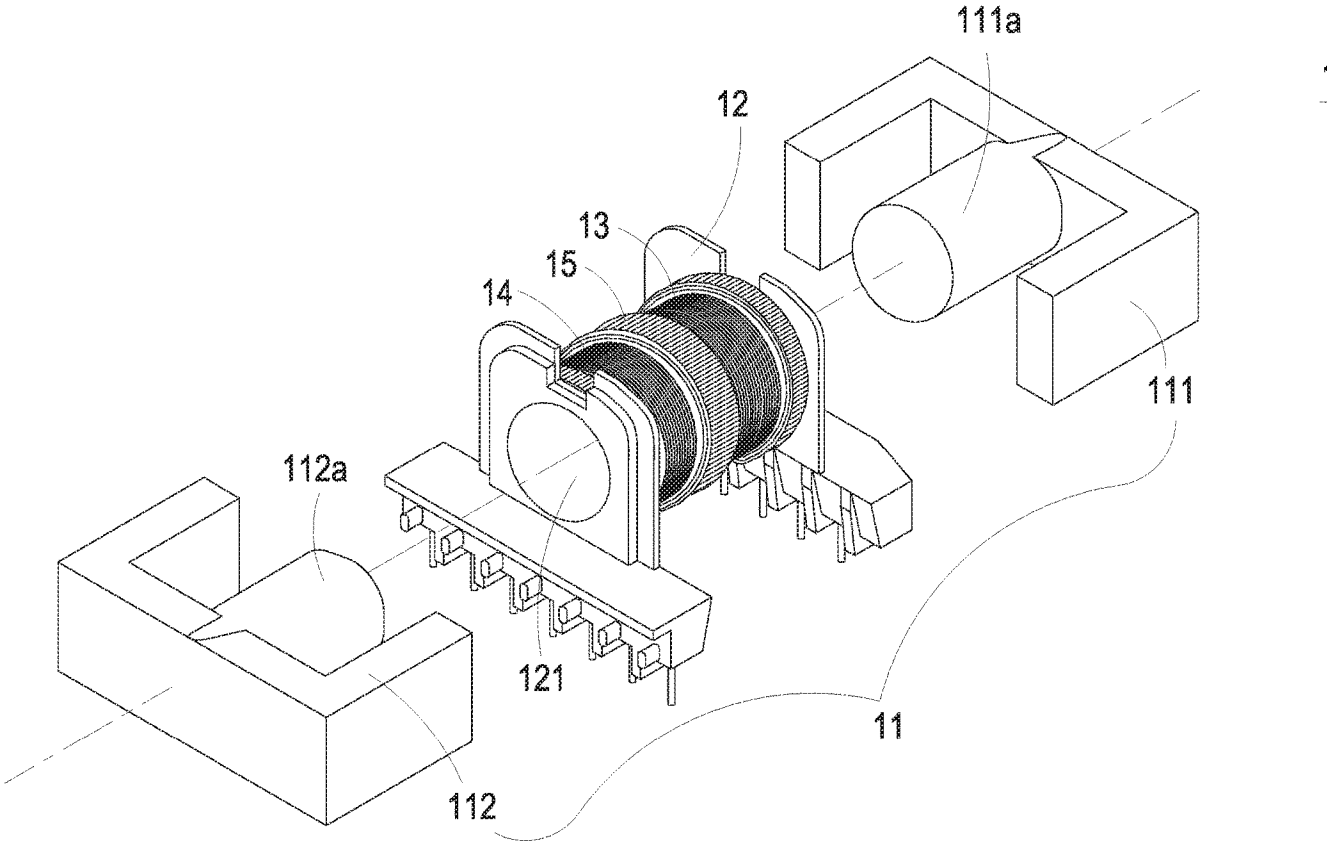
FIG. 1 PRIOR ART
FIG. 1. is a schematic exploded view illustrating a conventional transformer.
Figure 2A:
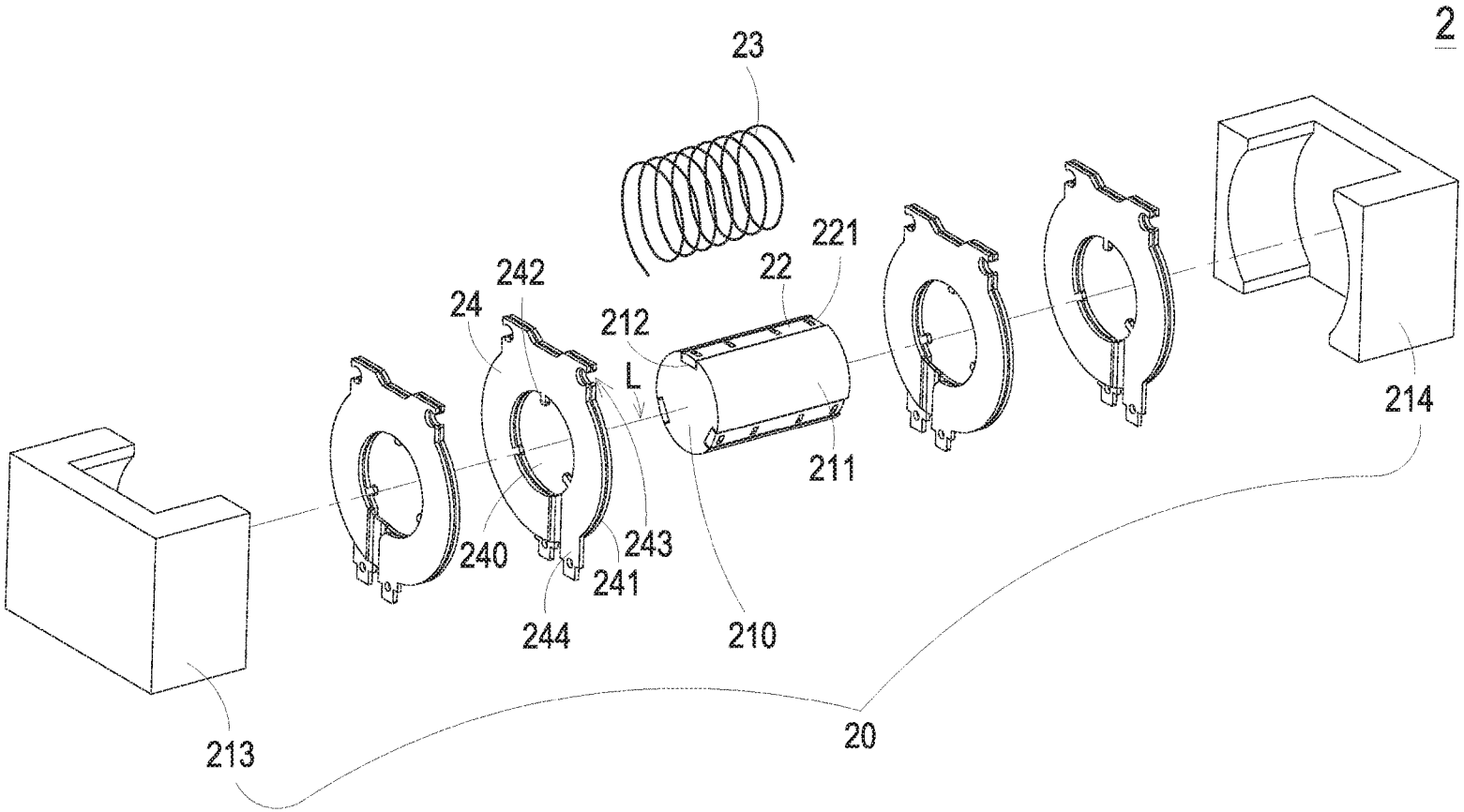
FIG. 2A is a schematic exploded view illustrating a magnetic component according to a first embodiment of the present disclosure.
Figure 2B:
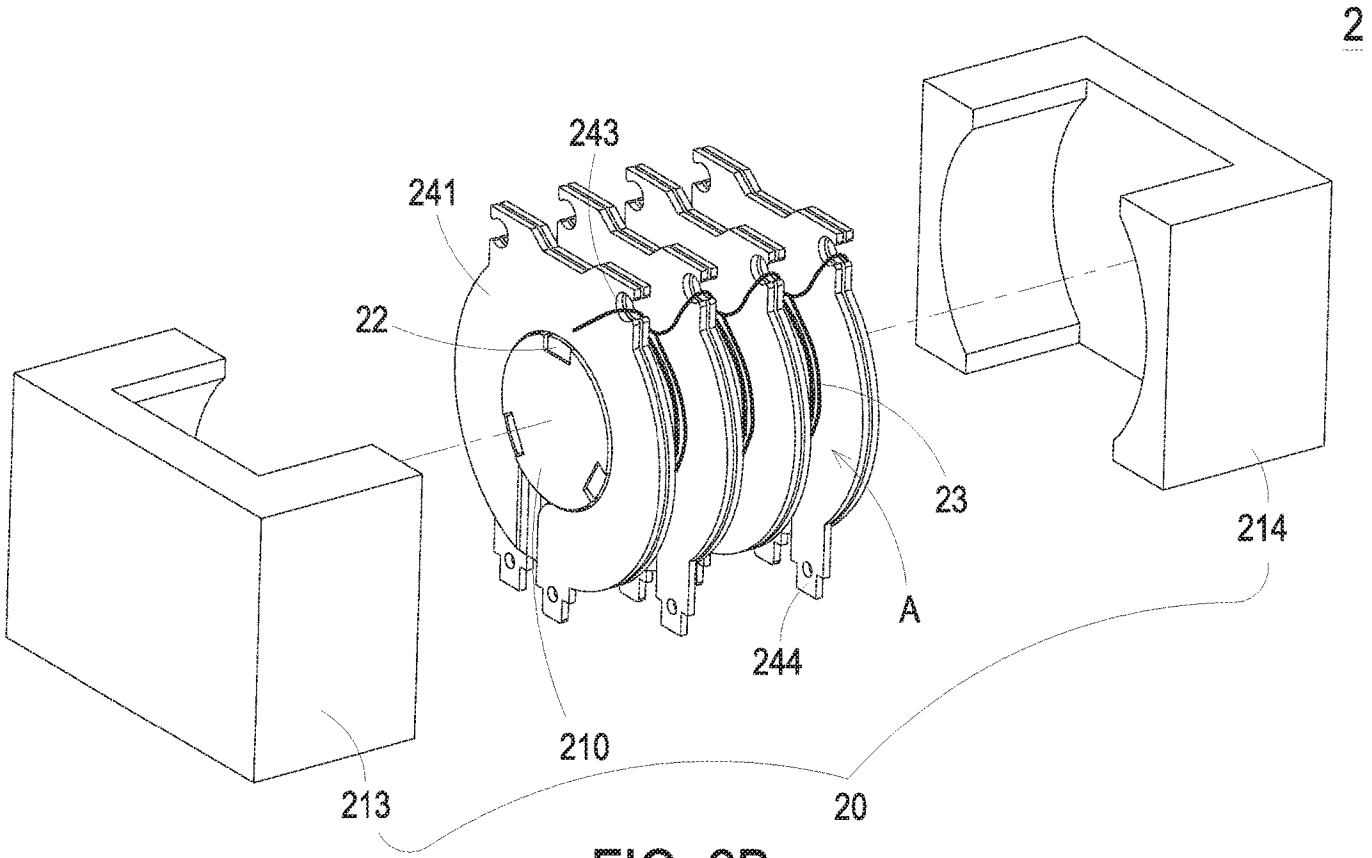
FIG. 2B is a schematic assembly view illustrating the magnetic component shown in FIG. 2A.

Referring to FIGS. 2A and 2B, a magnetic component 2 is provided, which can be, but not limited to, a transformer, an inductor or a filter. The magnetic component 2 includes a magnetic core assembly 20, at least a fastening set 22, a first winding set 23 and a plurality of second winding sets 24. The magnetic core assembly 20 includes at least a pillar 210 having an outer peripheral surface 211. The fastening set 22 is provided on the outer peripheral surface 211 of the pillar 210. The second winding sets 24 are spaced apart and sleeved around the outer peripheral surface 211 of the pillar 210. The second winding sets 24 may be affixed or attached on the pillar 210 via the fastening set 22 and configured to define at least a space for a winding zone A on the magnetic component 2. Namely, each two adjacent second winding sets 24 are configured to form the winding zone A. The first winding set 23 is insulated from the second winding sets 24, disposed around the outer peripheral surface 211 of the pillar 210, and located at the winding zone A. In the embodiment, the magnetic core assembly 20 further includes a first magnetic core 213 and a second magnetic core 214. The first winding set 23 and the second winding set 24 are partially enclosed by the first magnetic core 213 and the second magnetic core 214.

In the embodiment, the pillar 210 has a central axis L, and the fastening set 22 is elongate and extends parallel to the central axis L and is disposed on the outer peripheral surface 211 of the pillar 210. The fastening set 22 includes at least a first engaging portion 221. The first winding set 23 is an insulated winding coil. Preferably, the first winding set 23 may be a triple insulated coil. Each second winding set 24 is a flat coil. Preferably, the second winding set 24 may be a copper coil or a copper plate. Each second winding set 24 includes a conductive thin plate 241, which can be a one-turn winding or multi-turn winding with an outer insulated layer (not shown). The conductive thin plate 241 has two bare pins 244 formed as two output terminals of the second winding set 24. The conductive thin plate 241 of the second winding set 24 includes a circular hollow 240 configured for receiving the pillar 210, and the second winding set 24 includes at least a second engaging portion 242 connected to, or integral with, the conductive thin plate 241, located at the peripheral edge of the circular hollow 240 and extending toward the center of the circular hollow 240. The second winding set 24 is configured to be sleeved around the pillar 210 via the circular hollow 240, and the second engaging portion 242 of the second winding set 24 is configured to engage with the first engaging portion 221 of the fastening set 22 so as to locate the position of the second winding set 24 and fasten onto the pillar 210.

Figure 3B:
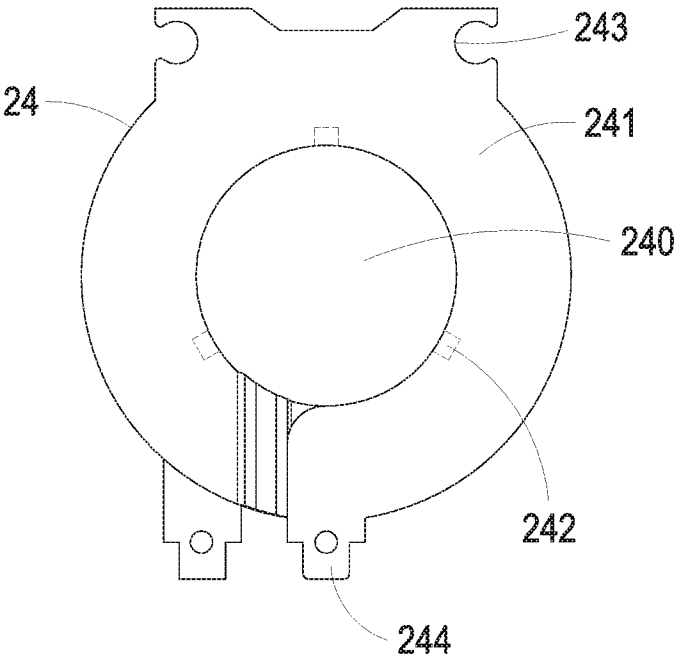
FIG. 3B is a front view illustrating the second winding set of the magnetic component according to the second embodiment of the present disclosure.
Figure 3A:
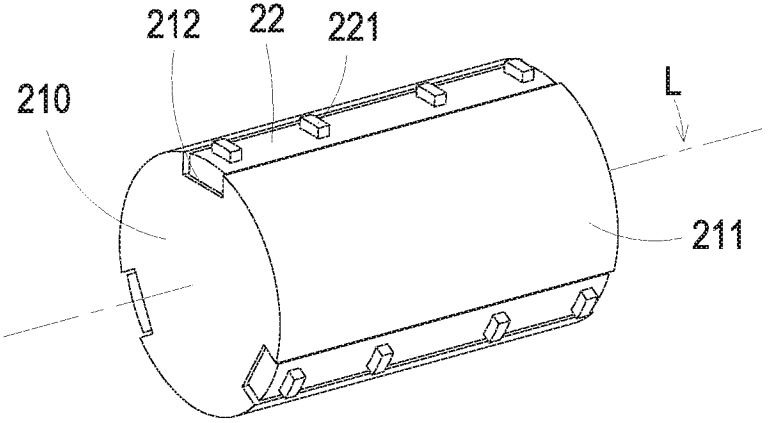
FIG. 3A is a schematic perspective view illustrating a partial structure of a magnetic component according to a second embodiment of the present disclosure.

In one form, the fastening set 22 is made using an insulation material, for example a flexible plastic material or rubber material. The pillar 210 further includes at least an elongate groove 212. The elongate groove 212 extends parallel to the central axis L and is inwardly recessed and disposed on the outer peripheral surface 211 of the pillar 210. The fastening set 22 is embedded in the elongate groove 212. The fastening set 22 can be embedded in the elongate groove 212 by methods such as tight-fitting or adhesive-bonding. In the embodiment shown in FIG. 2A, the first engaging portion 221 of the fastening set 22 is a recess and the second engaging portion 242 of the second winding set 24 is a protrusion. The protrusion and the recess are configured to engage with each other. Alternatively, as shown in FIGS. 3A and 3B, the first engaging portion 221 of the fastening set 22 is a protrusion and the second engaging portion 242 of the second winding set 24 is a recess. When assembled, the protrusion and the recess are engaged with each other. Consequently, with the engagement of the first engaging portion 221 of the fastening set 22 and the second engaging portion 242 of the second winding set 24, the second winding set 24 is sleeved and affixed around the outer peripheral surface 211 of the pillar 210 by the assistance of the fastening set 22. In the embodiment, the conductive thin plate 241 of the second winding set 24 is orthogonal to the outer peripheral surface 211 of the pillar 210.

In the embodiment, the magnetic component 2 includes three fastening sets 22, and the pillar 210 includes three elongate grooves 212, wherein the three fastening sets 22 are embedded in the corresponding elongate grooves 212, respectively. Each fastening set 22 is a rod and includes a plurality of first engaging portions 221. The plurality of first engaging portions 221 are disposed on an exposed surface of the rod and are arranged and spaced apart at intervals, which can be the same distance intervals. Each fastening set 22 has a plurality of first engaging portions 221 located and corresponding to other first engaging portions 221 of other fastening sets 22. Preferably but not exclusively, each fastening set 22 has four first engaging portions 221. In the embodiment, the magnetic component 2 has four second winding sets 24, and each second winding set 24 has three second engaging portions 242. The four second winding sets 24 are sleeved around the pillar 210, spaced apart from each other and arranged on the pillar 210, so that three winding zones A are defined on the pillar 210. Each second winding set 24 has three second engaging portions 242 engaged with the three corresponding first engaging portions 221 disposed on three fastening sets 22, so that the second winding sets 24 are affixed around the pillar 210 via the three fastening sets 22. It is noted that the number of the first engaging portions 221 and the second engaging portions 242 are not intended to be limited to the above described embodiment, and can be configured and varied according to the desired practical requirements (for example, in accordance with ease of manufacture or design size/volume variations). The first winding set 23 is wound around the pillar 210 directly and in contact with the outer peripheral surface 211 of the pillar 210. The first winding set 23 can be wound and located at the plurality of winding zones A, so that the first winding set 23 and the second winding sets 24 are arranged in a staggered arrangement and disposed around the outer peripheral surface 211 of the pillar 210. It is noted that the number of the second winding sets 24 and the fastening sets 22 are not limited to the above described embodiment and can have varying configurations according to practical requirements.

A manufacturing method of the magnetic component 2 in the present disclosure is as follows. Firstly, a plurality of second winding sets 24 are sleeved on the pillar 210. Each second winding set 24 has three second engaging portions 242 corresponding to three fastening sets 22 and are engaged with the first engaging portions 221 of the three corresponding fastening set 22, so as to locate the second winding sets 24 and attach onto the pillar 210. Then, the first winding set 23 is directly wound on the pillar 210. When a part of the first winding set 23 has been wound on one winding zone A, the other part of the first winding set 23 is led to pass through a line-passing recess 243 of the second winding set 24 and further wound on an adjacent winding zone A. The winding step is performed sequentially so as to accomplish the winding process. In the embodiment, the line-passing recess 243 of the second winding set 24 is provided near the outer peripheral edge of the conductive thin plate 241 so as to facilitate the winding process of the first winding set 23 between two adjacent winding zones A. Consequently, the first winding set 23 and the plurality of second winding sets 24 of the magnetic component 2 are arranged in a staggered arrangement and disposed around the outer peripheral surface 211 of the pillar 210. Finally, the first winding set 23 and the second winding sets 24 are partially enclosed by the magnetic core assembly 20, so as to accomplish the structure of the magnetic component 2.

In an embodiment, the magnetic core assembly 20 can be formed by (for example but not limited to) a ferrite, a magnetic adhesive, an iron powder, a low temperature co-fired ceramic or a metallic magnetic material. The magnetic core assembly 20 comprises the cylindrical pillar 210, and also includes the first magnetic core 213 and the second magnetic core 214 partially enclosing the first winding set 23 and the plural second winding sets 24. In some embodiments, both of the first magnetic core 213 and the second magnetic core 214 have two lateral legs and one baseplate. For example, the first magnetic core 213 and the second magnetic core 214 are two U-type magnetic cores. The two lateral legs of the first magnetic core 213 couples with the two lateral legs of the second magnetic core 214. The pillar 210 has two end surfaces connected to the central areas of the baseplates of the first magnetic core 213 and the second magnetic core 214 respectively. The pillar 210 may be connected to the baseplate of the first magnetic core 213 or the second magnetic core 214 by an adhesive element. Alternatively, the pillar 210 may have an end surface connected to the central area of one baseplate of the first magnetic core 213 and the second magnetic core 214, and an air gap is formed between the end surface of the pillar 210 and the baseplate of the first magnetic core 213 or the second magnetic core 214. Alternatively, the pillar 210 may have two end surfaces connected to the baseplates of the first magnetic core 213 and the second magnetic core 214 respectively so as to form an air gap between the pillar of the first magnetic core 213 and the pillar of the second magnetic core 214. In the embodiment, the first winding set 23 and the plurality of second winding sets 24 of the magnetic component 2 are arranged in a staggered arrangement and disposed around the outer peripheral surface 211 of the pillar 210. Under this arrangement, the air gap located at the end surface of the pillar 210 does not cut the magnetic loop induced by the first winding set 23 and the second winding sets 24, and so the magnetic density isn't impaired. Consequently, any copper loss of winding caused by the air gap is avoided.

In some embodiments, the first magnetic core 213 and the second magnetic core 214 are two E-type magnetic cores. Each of the first magnetic core 213 and the second magnetic core 214 has two lateral legs, a central pillar and a baseplate. The central pillars of the first magnetic core 213 and the second magnetic core 214 are constructed as the pillar 210 of the magnetic component 2. In some embodiments, the first magnetic core 213 is a U-type magnetic core and the second magnetic core 214 is a T-type magnetic core. In this embodiment, the first magnetic core 213 may have two lateral legs and a baseplate, and the second magnetic core 214 has the pillar 210 and a baseplate. It is noted that the combination and the constructed types of the magnetic core assembly 20 are not limited to the above described embodiments, and variations are envisaged according to practical requirement. For example, the first magnetic core 213 and the second magnetic core 214 can be an E-type magnetic core and an I-type magnetic core respectively.

Figure 4A:
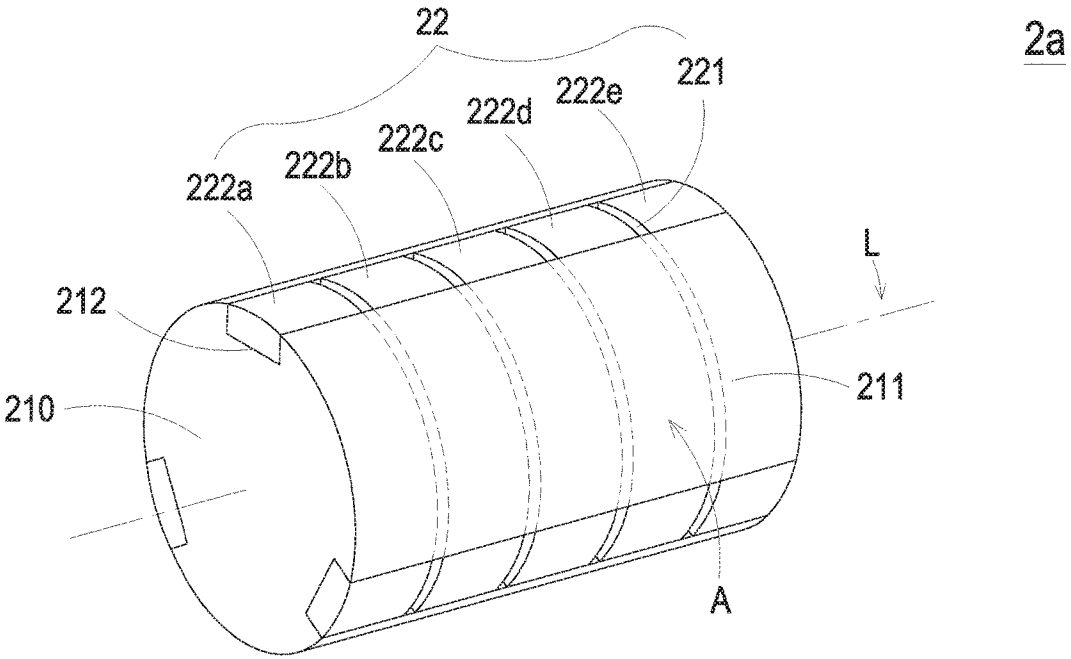
FIG. 4A is a schematic perspective view illustrating a partial structure of a magnetic component according to a third embodiment of the present disclosure.
Figure 4C:
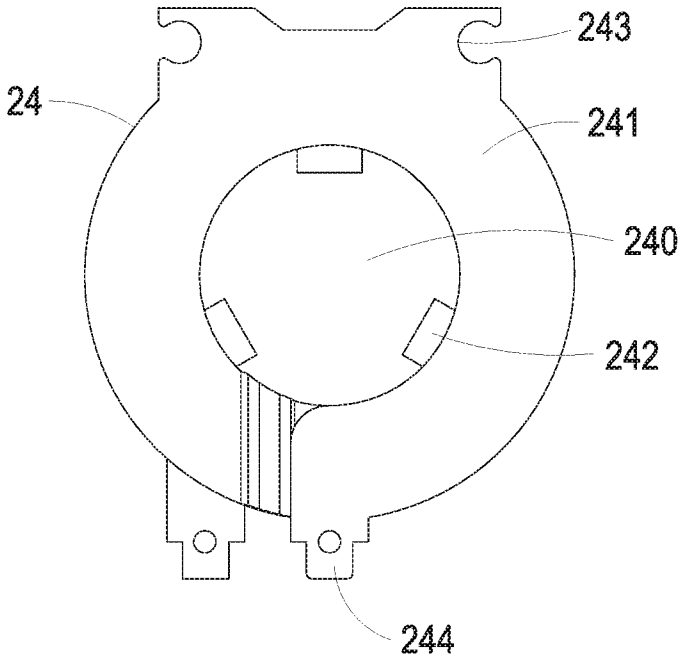
FIG. 4C is a front view illustrating the second winding set of the magnetic component according to the third embodiment of the present disclosure.
Figure 4B:
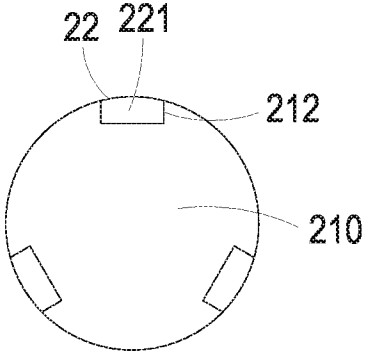
FIG. 4B is a cross-sectional view illustrating the partial structure of the magnetic component shown in FIG. 4A.

Referring to FIGS. 4A, 4B, and 4C, in this embodiment, the structures, elements and functions of the magnetic component 2*a* are similar to those of the magnetic component 2 in FIGS. 2A and 2B. Of different form to the magnetic component 2 in FIGS. 2A and 2B, the magnetic component 2*a* includes a configuration variation of fastening sets 22 and elongate grooves 212. The three fastening sets 22 are embedded in the corresponding elongate grooves 212 respectively. Each fastening set 22 includes a plurality of patched pieces 222*a*, 222*b*, 222*c*, 222*d*, 222*e* and a plurality of first engaging portions 221. The patched pieces 222*a*, 222*b*, 222*c*, 222*d*, 222*e* of each fastening set 22 are embedded in the same elongate groove 212. The patched pieces 222*a*, 222*b*, 222*c*, 222*d*, 222*e* are spaced apart and form the first engaging portions 221 on the pillar 210, and are arranged in intervals (which may be same or varied). In one form, the number of the patched pieces 222*a*, 222*b*, 222*c*, 222*d*, 222*e* of each fastening set 22 is five, and the number of the first engaging portions 221 of each fastening set 22 is four. It is noted that the number of the patched pieces 222*a*, 222*b*, 222*c*, 222*d*, 222*e* and the first engaging portions 221 of each fastening set 22 are not limited to the abovementioned embodiment and can be varied to meet practical requirements such as size/volume of the desired design and/or manufacturability. In the embodiment, the magnetic component 2*a* includes four second winding sets 24, and each second winding set 24 includes three second engaging portions 242. The four second winding sets 24 are sleeved on the pillar 210 and spaced apart at intervals, so as to define and form three winding zones A. Each second winding set 24 has three second engaging portions 242 respectively engaged with the corresponding first engaging portions 221 of three fastening sets 22, so that the second winding sets 24 are affixed and located on the pillar 210. In the embodiment, the first engaging portion 221 is a recess and the second engaging portion 242 is a protrusion. Alternatively, this configuration could be vice versa. The first winding set 23 is wound directly on the pillar 210 and is in contact with the outer peripheral surface 211 of the pillar 210. The first winding set 23 is wound on the winding zones A, so that the first winding set 23 and the second winding sets 24 are arranged in a staggered arrangement and disposed around the outer peripheral surface 211 of the pillar 210. It is noted that the number of the second winding sets 24 and the fastening sets 22 are not limited to the abovementioned embodiment and can be varied according to practical requirements.

Figure 5A:
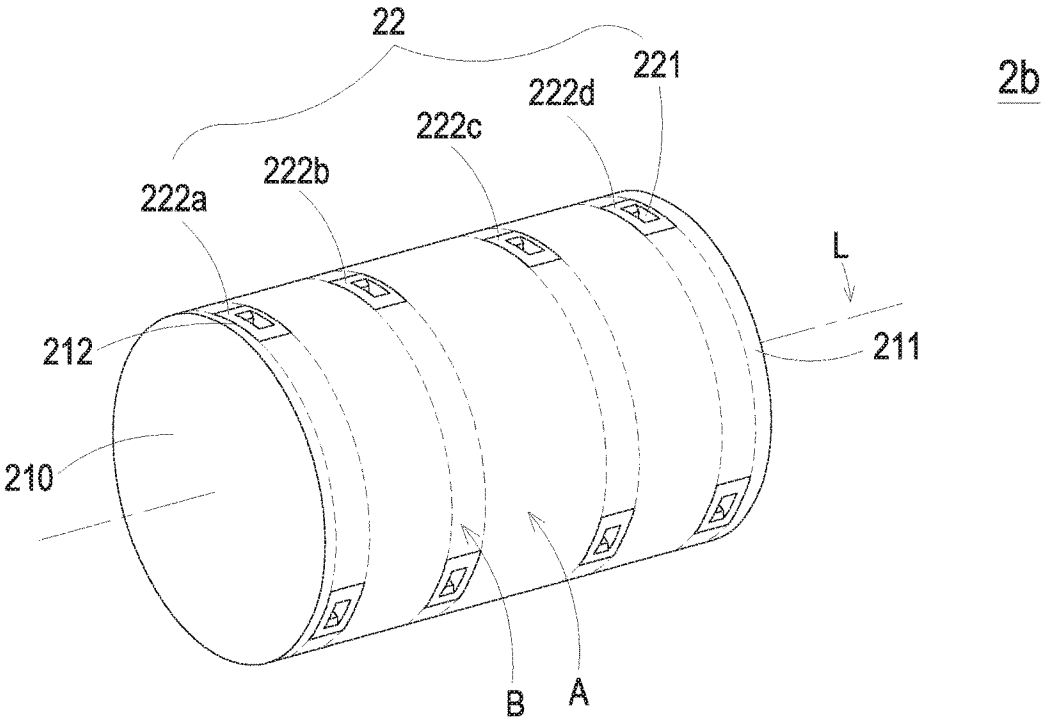
FIG. 5A is a schematic perspective view illustrating a partial structure of a magnetic component according to a fourth embodiment of the present disclosure.
Figure 5C:
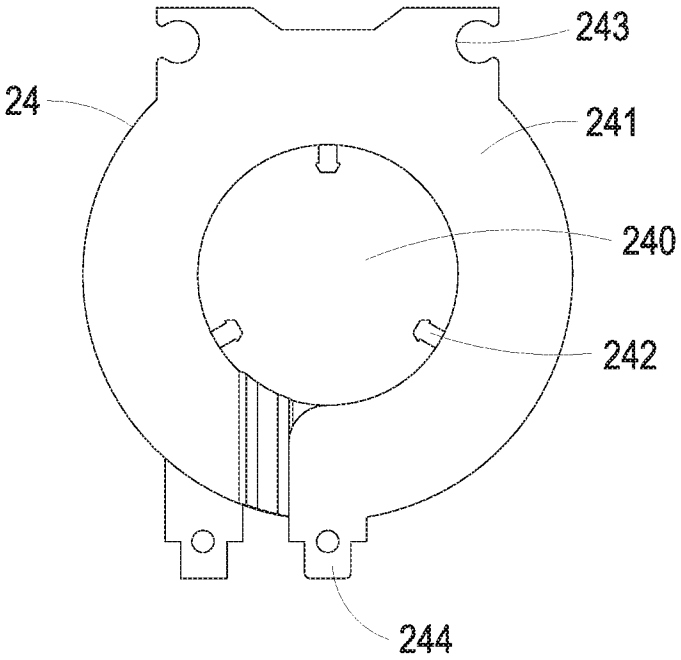
FIG. 5C is a front view illustrating the second winding set of the magnetic component according to the fourth embodiment of the present disclosure.
Figure 5B:
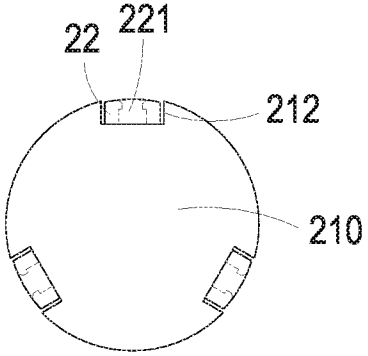
FIG. 5B is a cross-sectional view illustrating the partial structure of the magnetic component shown in FIG. 5A.

Referring to FIGS. 5A, 5B, and 5C, in this embodiment, the structures, elements and functions of the magnetic component 2*b* are similar to those of the magnetic component 2*a* in FIGS. 4A, 4B and 4C. Of different form to the magnetic component 2*a* in FIGS. 4A, 4B and 4C, the magnetic component 2*b* includes three fastening sets 22 and the pillar 210 includes a plurality of grooves 212 arranged in arrays. Each fastening set 22 includes a plurality of patched pieces 222*a*, 222*b*, 222*c*, 222*d* embedded in the corresponding grooves 212. Each patched piece 222*a*, 222*b*, 222*c*, 222*d* has a first engaging portion 221 arranged in arrays and disposed around the outer peripheral surface 211 of the pillar 210. A plurality of sleeved zones B are defined on the outer peripheral surface 211 of the pillar 210 for allowing the second winding sets 24 to be attached thereon and to be spaced apart. In the embodiment, the plurality of fastening sets 22 are configured to define the plurality of sleeved zones B and winding zones A on the outer peripheral surface 211 of the pillar 210. The winding zones A and the sleeved zones B are in staggered arrangement and located at the outer peripheral surface 211 of the pillar 210. In this embodiment, the number of the patched pieces 222*a*, 222*b*, 222*c*, 222*d* of each fastening set 22 is four, and the number of the first engaging portions 221 of each fastening set 22 is four. It is noted that the number of the patched pieces 222*a*, 222*b*, 222*c*, 222*d* and the first engaging portions 221 of each fastening set 22 are not limited to the above embodiment and can be varied according to practical requirements. In the embodiment, preferably but not exclusively, the magnetic component 2 includes four second winding sets 24 and each second winding set 24 includes three second engaging portions 242. The four second winding sets 24 are sleeved on the pillar 210 and spaced apart at intervals, so as to define and form three winding zones A. Three second engaging portions 242 of each second winding set 24 are engaged with the corresponding the first engaging portions 221 of three fastening sets 22 respectively, so that the second winding sets 24 are affixed and located on the pillar 210 via the three fastening sets 22. In the embodiment, the first engaging portion 221 is a recess and the second engaging portion 242 is a protrusion. The first winding set 23 is wound directly on the pillar 210, and is in contact with the outer peripheral surface 211 of the pillar 210. The first winding set 23 is wound on the winding zones A, so that the first winding set 23 and the second winding sets 24 are arranged in a staggered arrangement and disposed around the outer peripheral surface 211 of the pillar 210. It is noted that the number of the second winding sets 24 and the fastening sets 22 are not limited to the abovementioned embodiment, and can be varied according to practical requirements.

Figure 6B:
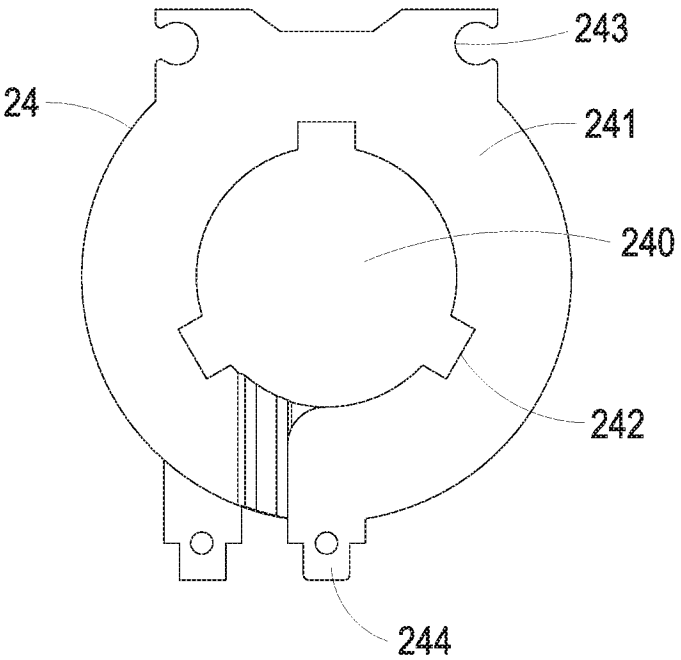
FIG. 6B is a front view illustrating the second winding set of the magnetic component according to the fifth embodiment of the present disclosure.
Figure 6A:
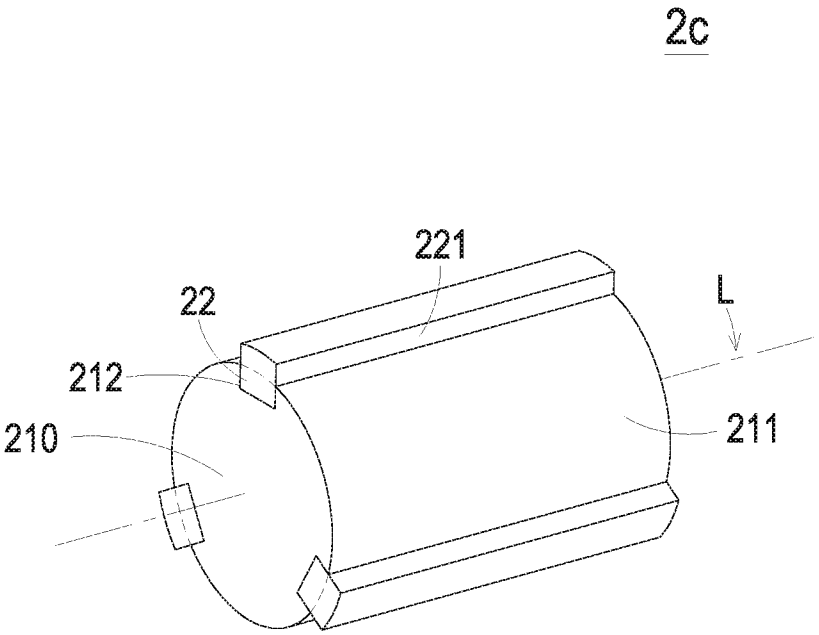
FIG. 6A is a schematic perspective view illustrating a partial structure of a magnetic component according to a fifth embodiment of the present disclosure.

Referring to FIGS. 6A and 6B, in this embodiment, the structures, elements and functions of the magnetic component 2*c* are similar to those of the magnetic component 2 in FIGS. 2A and 2B. Of different form to the magnetic component 2 in FIGS. 2A and 2B, the magnetic component 2*c* includes a plurality of fastening sets 22 embedded in the elongate grooves 212 of the pillar 210, and each fastening set 22 has the first engaging portion 221 having a portion protruding outwardly from the outer peripheral surface 211 of the pillar 210 and extending along a direction parallel to the central axis L. The first engaging portion 221 of the fastening set 22 protrudes from the pillar 210 and the second winding set 24 includes the second engaging portions 242 corresponding to the first engaging portions 221. Each second engaging portion 242 is a recess and is configured to engage with the corresponding first engaging portions 221 respectively so as to locate the second winding sets 24 and engage onto the pillar 210 by the assistance of the fastening sets 22.

Figure 7B:
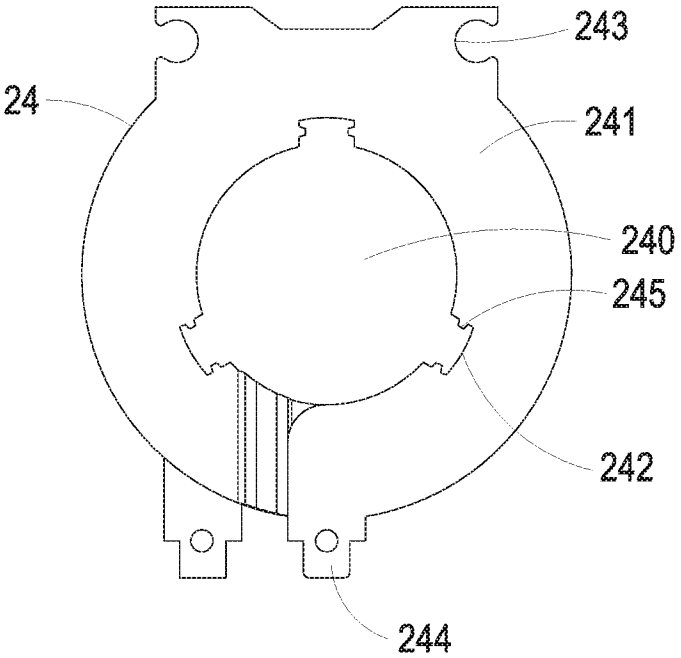
FIG. 7B is a front view illustrating the second winding set of the magnetic component according to the sixth embodiment of the present disclosure.
Figure 7A:
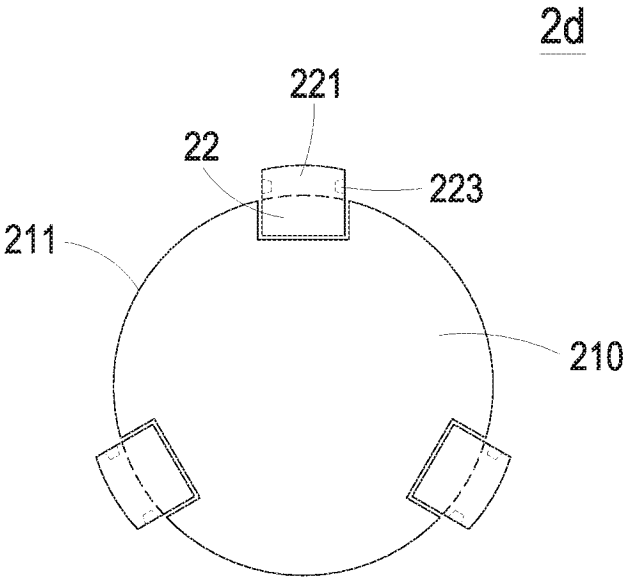
FIG. 7A is a cross-sectional view of a partial structure of a magnetic component according to a sixth embodiment of the present disclosure.

Referring to FIGS. 7A and 7B, in this embodiment, the structures, elements and functions of the magnetic component 2*d* are similar to those of the magnetic component 2*c* in FIGS. 6A and 6B. Of different form to the magnetic component 2*c* in FIGS. 6A and 6B, in this embodiment, each fastening set 22 includes the first engaging portion 221 having at least a first positioning element 223, and each second winding set 24 includes the second engaging portion 242 having at least a second positioning element 245. In the embodiment, the first positioning element 223 is a positioning recess and the second positioning element 245 is a positioning protrusion which engages with each other, so as to affix and locate the second winding sets 24 on the outer peripheral surface 211 of the pillar 210 more firmly by the assistance of the fastening sets 22.

Figure 8B:
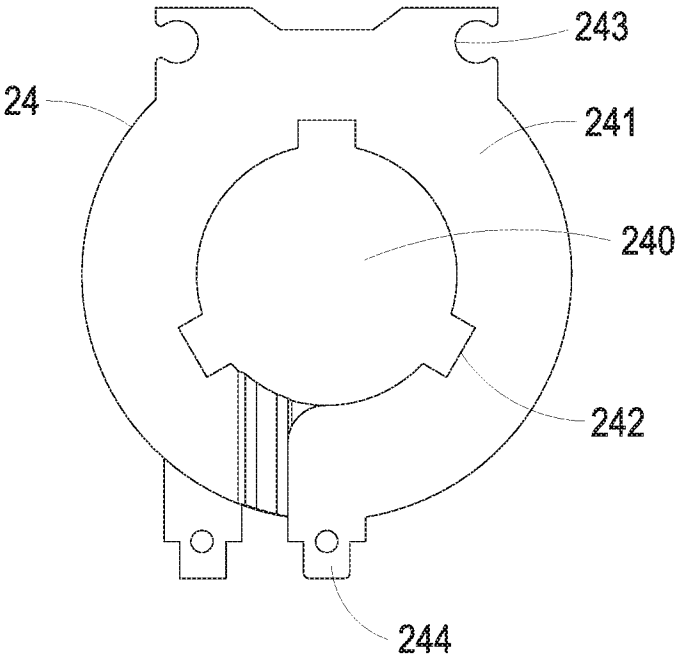
FIG. 8B is a front view illustrating the second winding set of the magnetic component according to the seventh embodiment of the present disclosure.
Figure 8A:
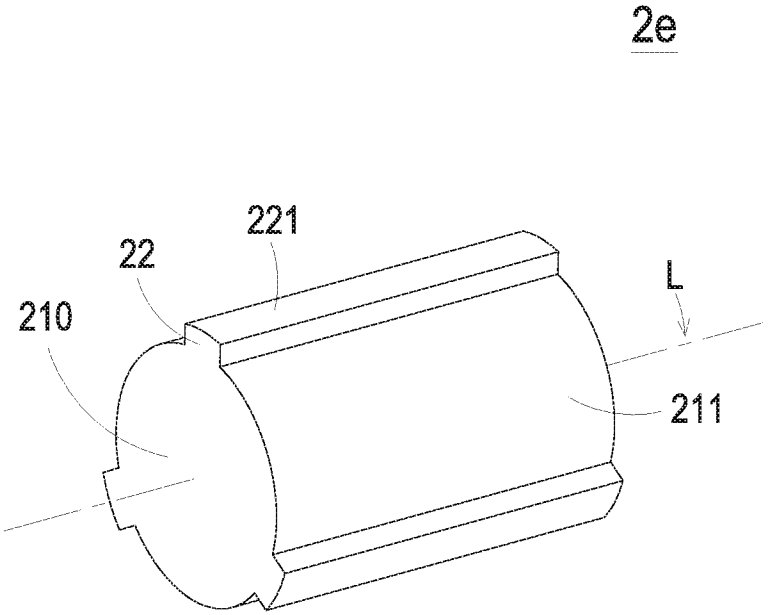
FIG. 8A is a schematic perspective view illustrating a partial structure of a magnetic component according to a seventh embodiment of the present disclosure.

Referring to FIG. 8A and FIG. 8B, in this embodiment, the structures, elements and functions of the magnetic component 2*e* are similar to those of the magnetic component 2*c* in FIGS. 6A and 6B. Of different form to the magnetic component 2*c* in FIGS. 6A and 6B, in this embodiment, the fastening set 22 has the first engaging portion 221 including a rib integral with the pillar 210 to form one piece, and extend along and protrude outwardly from the outer peripheral surface 211 of the pillar 210. The second winding set 24 includes the second engaging portion 242 corresponding to the first engaging portion 221. The second engaging portion 242 is an indent configured to clasp and engage with the rib of the first engaging portion to effect an engagement of the second winding set with the fastening set. In the embodiment, the fastening sets 22 and the pillar 210 are formed by the same material.

Figure 9B:
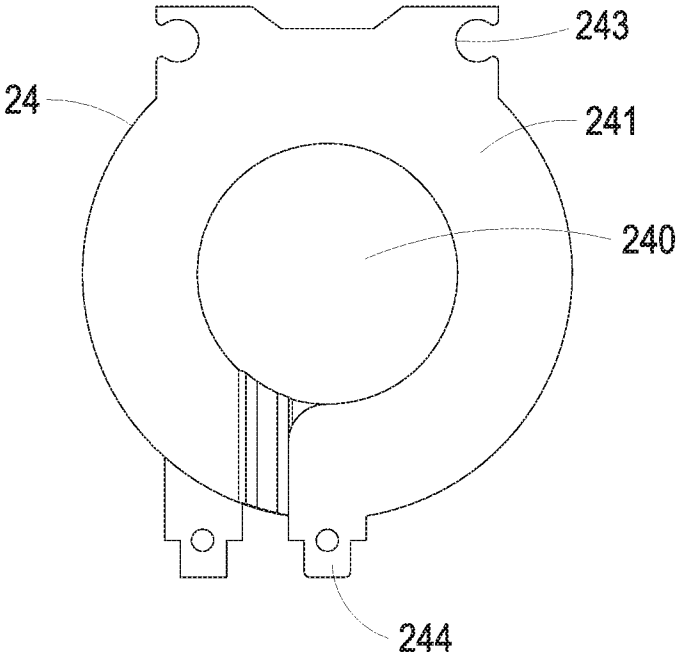
FIG. 9B is a front view illustrating the second winding set of the magnetic component according to the eighth embodiment of the present disclosure.
Figure 9A:
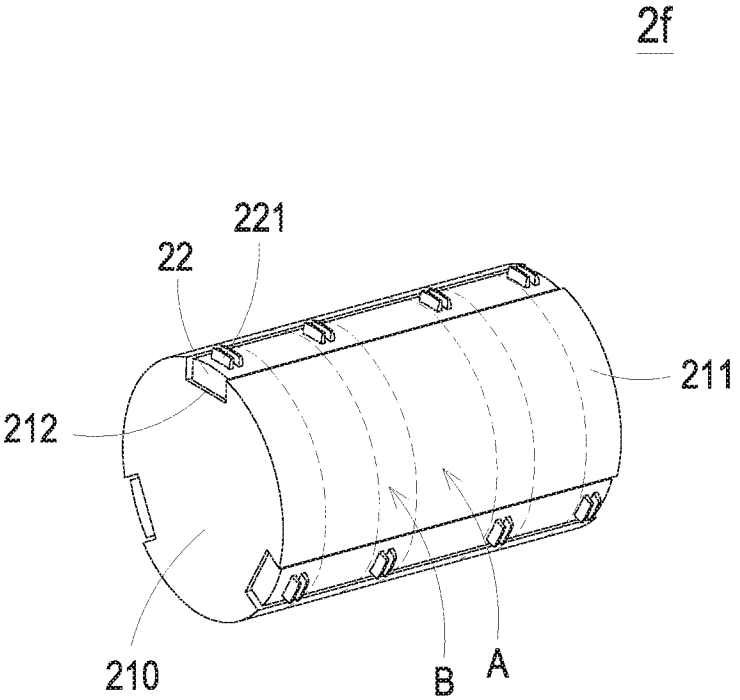
FIG. 9A is a schematic perspective view illustrating a partial structure of a magnetic component according to an eighth embodiment of the present disclosure.

Referring to FIG. 9A and FIG. 9B, in this embodiment, the structures, elements and functions of the magnetic component 2*f* are similar to those of the magnetic component 2 in FIGS. 2A and 2B. Of different form to the magnetic component 2 in FIGS. 2A and 2B, the magnetic component 2*f* includes the fastening sets 22 having the first engaging portions 221, and each of the first engaging portion 221 is shaped like a buckle. The first engaging portions 221 is configured to attach, buckle or clip to a peripheral edges of the circular hollow 240 of the conductive thin plate 241 of the second winding set 24. Accordingly, the second winding sets 24 may be affixed and located at the outer peripheral surface 211 of the pillar 210 by the assistance of the fastening sets 22.

In accordance with an aspect of the present disclosure, the bobbinless magnetic component 2 has the first winding set 23 directly wound around the outer peripheral surface 211 of the pillar 210 of the magnetic core assembly 20. Consequently, for a configuration of which the magnetic component is required to be of a fixed size, the bobbinless magnetic component 2 of the present disclosure can be more compact as it does not need to provide for space for the wall thickness of a bobbin. As the first winding set 23 and the second winding sets 24 are divided by the conductive thin plate of the second winding set 24, instead of needing to utilize an insulating tape or an additional separated plate, the winding space and the winding turns of the magnetic component may be increased and the efficiency of the magnetic component may be improved. The present disclosure also provides for reduced material cost, and a smaller volume of the magnetic component for improved ease of assembly.

While the disclosure has been described in terms of what is presently considered to be the more practical and preferred embodiments, it is to be understood that the disclosure need not be limited. It is intended to cover various modifications and similar arrangements included within the spirit and scope of the appended claims which are to be accorded with the broadest interpretation so as to encompass all such modifications and similar structures.

What is claimed is:

1. A magnetic component comprising:

a magnetic core assembly comprising a pillar, wherein the pillar comprises a groove inwardly recessed and located on an outer peripheral surface of the pillar;

a fastening set provided on the outer peripheral surface of the pillar and embedded in the groove of the pillar;

a first winding set disposed around the outer peripheral surface of the pillar; and a second winding set disposed around the outer peripheral surface of the pillar and engaged with the fastening set.

2. The magnetic component according to claim 1, wherein the fastening set comprises a first engaging portion and the second winding set comprises a hollow configured for receiving the pillar, and wherein the second winding set further comprises a second engaging portion located at a peripheral edge of the hollow configured to engage with the first engaging portion to define a space for a winding zone on the magnetic component.

3. The magnetic component according to claim 2, wherein the first engaging portion comprises one or more protrusions and the second engaging portion comprises one or more recesses; or the first engaging portion comprises one or more recesses and the second engaging portion comprises one or more protrusions.

4. The magnetic component according to claim 2, wherein the fastening set is elongate and extends parallel to a central axis of the pillar.

5. The magnetic component according to claim 2, wherein the first engaging portion comprises a portion protruding outwardly from the outer peripheral surface of the pillar.

6. The magnetic component according to claim 5, wherein the first engaging portion comprises a first positioning element, and the second engaging portion comprises a second positioning element, and wherein the first and second positioning elements are configured to engage with each other.

7. The magnetic component according to claim 2, wherein the fastening set is a rod embedded in the groove, and the first engaging portion is disposed on an exposed surface of the rod.

8. The magnetic component according to claim 2, wherein the fastening set includes a plurality of patched pieces embedded in the groove and spaced at intervals to define the one or more first engaging portions between each adjacent patched pieces, and wherein the first engaging portions is configured for engaging with the second engaging portion.

9. The magnetic component according to claim 1, wherein a plurality of fastening sets embedded in a plurality of grooves are provided and arranged in arrays.

10. The magnetic component according to claim 2, wherein the second winding set is a conductive thin plate comprising the hollow, and the first engaging portion comprises a buckle configured to attach to the peripheral edge of the hollow.

11. The magnetic component according to claim 1, wherein the first winding set comprises a triple insulated coil, and the second winding set comprises a copper plate.

12. The magnetic component according to claim 1, wherein the pillar comprises two end surfaces and the magnetic core assembly further comprises a first magnetic core and a second magnetic core, and wherein each of the first magnetic core and the second magnetic core is configured to connect with one of the two end surfaces of the pillar.

13. The magnetic component according to claim 1, wherein the pillar comprises two end surfaces and the magnetic core assembly further comprises a first magnetic core and a second magnetic core, and wherein the first magnetic core is configured to connect with one of the two end surfaces of the pillar and the second magnetic core is configured to provide for an air gap between the second magnetic core and another one of the two end surfaces of the pillar.

14. The magnetic component according to claim 1, wherein the first winding set and the second winding set are located adjacent to each other and disposed around the outer peripheral surface of the pillar.

15. The magnetic component according to claim 1, wherein the magnetic component is a transformer, an inductor, or a filter.

16. A magnetic component comprising:

a magnetic core assembly comprising a pillar;

a fastening set provided on an outer peripheral surface of the pillar, and comprising a rib integral with the pillar, wherein the rib extends along and protrudes outwardly from the outer peripheral surface of the pillar;

a first winding set disposed around the outer peripheral surface of the pillar; and a second winding set disposed around the outer peripheral surface of the pillar and engaged with the fastening set, wherein the second winding set comprises an indent configured to clasp the rib to effect an engagement of the second winding set with the fastening set.

* * * * *